US010407209B1

(12) United States Patent
Choi et al.

(10) Patent No.: US 10,407,209 B1
(45) Date of Patent: Sep. 10, 2019

(54) PALLET APPARATUS FOR TRANSPORTATION OF CAR GLASS

(71) Applicant: NPC CO., LTD., Gyeonggi-do (KR)

(72) Inventors: Dae Hyun Choi, Seoul (KR); Oh Seong Kim, Seoul (KR)

(73) Assignee: NPC Co., Ltd., Ansan-si, Gyeonggi-do (KR)

( * ) Notice: Subject to any disclaimer, the term of this patent is extended or adjusted under 35 U.S.C. 154(b) by 0 days.

(21) Appl. No.: 16/013,895

(22) Filed: Jun. 20, 2018

(30) Foreign Application Priority Data

May 11, 2018 (KR) ..... 10-2018-0054461

(51) Int. Cl.
*B65D 19/44* (2006.01)
*B65D 19/12* (2006.01)
(Continued)

(52) U.S. Cl.
CPC ..... *B65D 19/12* (2013.01); *B65D 19/44* (2013.01); *B65D 71/0096* (2013.01);
(Continued)

(58) Field of Classification Search
CPC ..... B65D 85/48; B65D 2519/00671; B65D 2519/00676; B65D 2519/00681;
(Continued)

(56) References Cited

U.S. PATENT DOCUMENTS 3,147,860 A * 9/1964 Kean, Sr. ..... B65D 19/08 108/53.5
3,804,033 A * 4/1974 Izawa ..... B65D 19/385 108/53.5
(Continued)

FOREIGN PATENT DOCUMENTS

DE 11 32 305 B 6/1962
FR 2 740 435 A1 4/1997
(Continued)

OTHER PUBLICATIONS

European Patent Office, Extended European Search Report, Application No. 18179627.7, dated Nov. 19, 2018, 6 pages.
(Continued)

*Primary Examiner* — Matthew W Ing
(74) *Attorney, Agent, or Firm* — Sunstein Kann Murphy & Timbers LLP

(57) ABSTRACT

The present invention relates to a pallet apparatus for transportation of car glass, and particularly, to a pallet apparatus for transportation of car glass according to the present invention includes: a pallet on which a car glass is loaded; and legs including front legs which are spaced apart from each other, disposed at left and right front sides of the pallet, and installed to be foldable in a front-rear direction, and rear legs which are spaced apart from the front legs, installed to be foldable in the front-rear direction, and disposed at a rear side of the pallet so that the car glass is leaned on the rear legs, wherein a lateral width between the front legs is greater than that between the rear legs, when the front legs and the rear legs are folded, the front legs and the rear legs are located at mutual side portions thereof, and efficiency of car glass transportation is high and cost is decreased due to the above configuration.

8 Claims, 12 Drawing Sheets

(51) Int. Cl.
*B65D 85/48* (2006.01)
*B65D 71/00* (2006.01)

(52) U.S. Cl.
CPC .... *B65D 85/48* (2013.01); *B65D 2519/00059* (2013.01); *B65D 2519/0089* (2013.01); *B65D 2519/00164* (2013.01); *B65D 2519/00273* (2013.01); *B65D 2519/00815* (2013.01)

(58) Field of Classification Search
CPC ..... B65D 2519/00686; B65D 2519/00691; B65D 2519/00696; B65D 2519/00875; B65D 2519/00925; B65D 19/12
See application file for complete search history.

(56) References Cited

U.S. PATENT DOCUMENTS

| | | | | |
|---|---|---|---|---|
| 4,662,532 | A * | 5/1987 | Anderson | B65D 19/12 220/1.5 |
| 5,154,310 | A | 10/1992 | Massey | |
| 2011/0192760 | A1* | 8/2011 | Joubert | B65D 19/12 206/600 |
| 2013/0233811 | A1* | 9/2013 | Glover | B65D 19/12 211/41.14 |
| 2015/0257530 | A1* | 9/2015 | Naka | A47B 47/0091 211/188 |
| 2018/0346238 | A1* | 12/2018 | Cheke | A47F 7/0042 |

FOREIGN PATENT DOCUMENTS

| | | | |
|---|---|---|---|
| JP | S48 52259 | U | 7/1973 |
| JP | H07 215339 | A | 8/1995 |
| JP | 2002 037373 | A | 2/2002 |
| JP | 2002037373 | A | 2/2002 |
| KR | 20-2000-0003761 | U | 2/2000 |
| KR | 10-1225468 | | 1/2013 |
| KR | 10-2013-0115111 | A | 10/2013 |
| KR | 10-1384013 | B | 4/2014 |
| KR | 10-1393207 | | 4/2014 |
| KR | 10-1640245 | | 7/2016 |
| WO | WO 91/00222 | | 1/1991 |

OTHER PUBLICATIONS

Korean Intellectual Property Office, Office Action, Application No. 10-2018-0054461, dated May 10, 2019, 13 pages (with English translation).

* cited by examiner

PALLET APPARATUS FOR TRANSPORTATION OF CAR GLASS

This application claims priority from Korean patent application No. 10-2018-0054461 filed May 11, 2018, the full disclosure of which is hereby incorporated by reference herein in its entirety.

BACKGROUND

1. Technical Field

The present invention relates to a pallet apparatus for transportation of car glass, and more particularly, to a pallet apparatus for transportation of car glass, on which a plurality of car glasses may be loaded and transported.

2. Description of Related Art

Generally, front car glasses or rear car glasses are formed to be vertically or horizontally curved, and a plurality of front car glasses or rear car glasses are packed or loaded on a pallet and safely transported in a state in which the plurality of front car glasses or rear car glasses are spaced apart from or pressed against each other.

In order to safely transport the plurality of car glasses without causing damage, pallets having various structures for loading car glasses have been developed. In addition, in the case of a pallet for loading only the car glasses, studies on transporting a large number of car glasses at once and making the pallet have shock absorption and durability to prevent damage of the car glasses and the pallet from external shock when the car glasses are exported, imported, or transported a long distance have been performed. More specifically, car glasses are loaded on a box and transported, wherein the box having a frame type is formed by bending thin iron plates to form legs and supports and coupling the legs and the supports using bolts. However, this method is used for a single-use packaging so thus cost is high. Since all of the leg and the supports are coupled by the bolts, it takes a long time to pack the car glasses, and disposal of waste materials is not easy in a country in which waste material recycling is not actuated when the box is used for exportation.

In addition, in the case of rear car glasses, when the rear car glasses which are pressed against each other are loaded on and supported by rear legs, the center of gravity of the box is shifted to one side of the pallet, and when the box is inclined toward one side while a forklift runs in that state, an accident in which the box or glasses fall may occur. Since the rear car glasses have to be loaded on an area smaller than a total area of the pallet to adjust the center of gravity of the box so as to avoid the accident, transportation efficiency is low.

As another method, an 'assembly type box for packaging heavyweight' disclosed in Korean Patent Registration No. 10-1225468 (hereinafter, referred to as 'patent document 1') includes a wooden pallet 100 in which support angles 300 having an 'L' shape is installed and front and rear sidewalls 330 and 340, which are boards, assembled by using vertical connecting angles 300. In the 'patent document 1' the support angles 300 are assembled to an upper surface of the pallet 100, and glasses are fixed using fixing belts 430.

Since the 'patent document 1' is for a single-use packaging method, cost is high, and since the support angles 300 and the pallet 100 are assembled using the bolts, it takes a long time and is inconvenient.

A technology which is similar to 'patent document 1' is disclosed as the related art in Korean Patent Registration No. 10-1393207 (hereinafter, referred as 'patent document 2').

In 'patent document 2', a triple thick corrugated cardboard box body 20 stands on a side surface of a pallet, lateral ducts 30 configured to serve as a leg supporting the box body 20 are additionally installed in the pallet, and brackets 10 in the form of a cap and configured to fix locations of the lateral ducts 30 are installed at upper and lower ends of the lateral ducts 30.

In 'patent document 2', since the brackets 10 have to be fixed to an upper surface of the pallet using bolts, it takes a long time and is inconvenient.

As still another method, there is a 'pallet for loading the automobile windows' disclosed in Korean Patent Registration No. 10-1640245 (hereinafter, referred to as 'patent document 3').

A pallet of 'patent document 3' may be used for multi-use because all bottoms and side and rear walls are formed of iron. In 'patent document 3', car glasses are loaded while leaned on the rear walls, glasses are fixed using belts, and empty pallets are collected upon bending the side walls to reduce volumes thereof.

Since the pallet in 'patent document 3' includes the iron bottoms and side and rear walls, the pallet is heavy. Accordingly, handling of the pallet is not easy, and when the pallet is used for exportation, the number of car glasses loaded in a container decreases due to a weight limitation of the container, and the pallet is expensive.

PRIOR-ART DOCUMENTS

Patent Documents (Patent Document 1) Korean Patent Registration No. 10-1225468

(Patent Document 2) Korean Patent Registration No. 10-1393207

(Patent Document 3) Korean Patent Registration No. 10-1640245

SUMMARY

1. Technical Problem

A technical objective of the present invention is to provide a pallet apparatus for transportation of car glass, of which a volume and a weight are less than those of a conventional pallet.

In addition, a technical objective of the present invention is to provide a pallet apparatus for transportation of car glass, by which car glasses are simply packed.

Further, a technical objective of the present invention is to provide a pallet apparatus for transportation of car glass, from which loaded car glasses do not escape.

Furthermore, a technical objective of the present invention is to provide a pallet apparatus for transportation of car glass, which does not interfere with components, in the case in which the components are attached to a car glass.

Moreover, a technical objective of the present invention is to provide a pallet apparatus for transportation of car glass configured to easily transport rear car glasses.

2. Solution to Problem

An embodiment for a pallet apparatus for transportation of car glass according to the present invention includes: a pallet on which a car glass is loaded; legs including front legs which are spaced apart from each other, disposed at left and right front sides of the pallet, and installed to be foldable in a front-rear direction, and rear legs which are spaced apart from the front legs, installed to be foldable in the front-rear direction, and disposed at a rear side of the pallet so that the car glass is leaned on the rear legs; and side bars including front and rear sides connected to the front legs and the rear legs, respectively, when the legs are unfolded, wherein a lateral width between the front legs is greater than that between the rear legs, and when the front legs and the rear legs are folded, the front legs and the rear legs are located at mutual side portions thereof, and the side bars are accommodated in side bar accommodation pieces installed on the pallet, and the side bars are located under the rear legs.

Leg insertion portions into which the legs may be inserted may be formed in the pallet, sliding holes into which shafts formed in the legs may be inserted may be formed in the leg insertion portions, and support plates in contact with lower surfaces of the legs may be formed at the leg insertion portions.

Separation prevention pieces configured to be in contact with the leg insertion portions may be formed in the legs, and when the leg is located at a lowermost side, a distance between a surface of the leg insertion portion and the separation prevention piece may be minimized or become zero.

A width of a lowermost side of the sliding hole may be the same as a diameter of the shaft, and widths of other portions of the sliding hole may be greater than the diameter of the shaft.

A fixing bar on which the car glass is loaded and a location change frame connected to the fixing bar may be installed in the pallet, and the fixing bar may be slid by the location change frame to change a location of the fixing bar.

The pallet apparatus for transportation of car glass may further include: a main banding strap including a front side and a rear side connected to the front side and the rear side of the pallet to surround the car glass; and side banding straps including upper sides and lower sides connected to the side bars and side portions of the pallet.

The pallet apparatus for transportation of car glass may further include stoppers formed on the front legs and the rear legs, wherein, when the legs are folded, the stoppers may be in contact with the pallet.

The pallet apparatus for transportation of car glass may further include a rear glass support wall installed in the pallet to be located between the rear legs and a center of the front side and the rear side of the pallet, wherein a rear car glass located at the center of the pallet may be leaned on the rear glass support wall.

3. Advantageous Effects

According to the present invention, a pallet apparatus for transportation of car glass has the following effects.

In the present invention, since there are no assembly processes using bolts, a packaging process is simpler than a single-use packaging process. In addition, since legs are present on only front and rear sides of the pallet, a volume of the pallet apparatus for transportation of car glass is less than that of a conventional pallet.

Since the legs are laterally disposed in parallel to each other when folded, a total volume of the pallet apparatus is less than that of the conventional pallet, and since the pallet is lighter than a pallet apparatus for multi-use packaging method, a large quantity of car glasses may be loaded at once.

Most components are formed of iron materials. Accordingly, the present invention generates less waste materials than a conventional single-use packaging method or rarely generates waste materials, and packaging cost is low.

Since a distance between both side fixing bars can be adjusted to be suitable for a curvature of a car glass, transportation efficiency is increased.

Since side bars and rear legs are not lifted upward from the pallet, locations thereof are maintained, and thus the car glass can be stably transported.

Since upper and front sides of the loaded car glass can be supported by a main banding strap, and left and right sides thereof can be blocked by side banding straps, and a rear side thereof is supported by the rear legs, and a lower side thereof is fixed by the fixing bars, a weight of the car glass can be uniformly dispersed to an entire of the pallet when the car glass is transported. Accordingly, the car glass loaded on the pallet apparatus of the present invention may be more stably supported than a car glass loaded on the conventional pallet.

Shaking of the leg is reliably prevented.

Since the legs are inserted into and supported by leg insertion portions, the legs are not lifted upward while the car glass is transported, and thus a situation in which the loaded car glass departs from the pallet does not occur.

Since accidental folding of the legs due to a mistake is rare, it is safe.

In a second embodiment of the present invention, since a rear car glass is loaded on the center of the front, rear, left, and right sides of the pallet apparatus for transportation of car glass, the center of gravity of the rear car glass is positioned at the center of the pallet, and thus a larger quantity of rear car glasses can be loaded on the pallet than a conventional pallet.

DETAILED DESCRIPTION OF EMBODIMENTS

Figure 1:
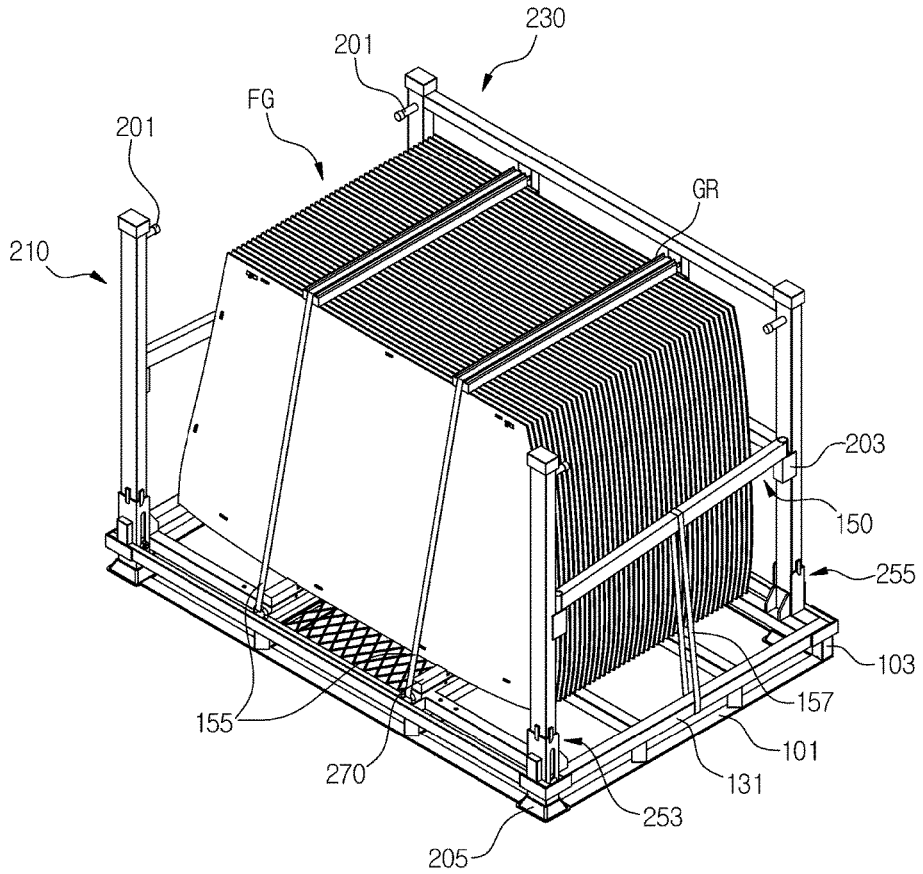
FIG. 1 is a perspective view illustrating a pallet apparatus for transportation of car glass, on which front car glasses are loaded according to a first embodiment of the present invention.
Figure 2A:
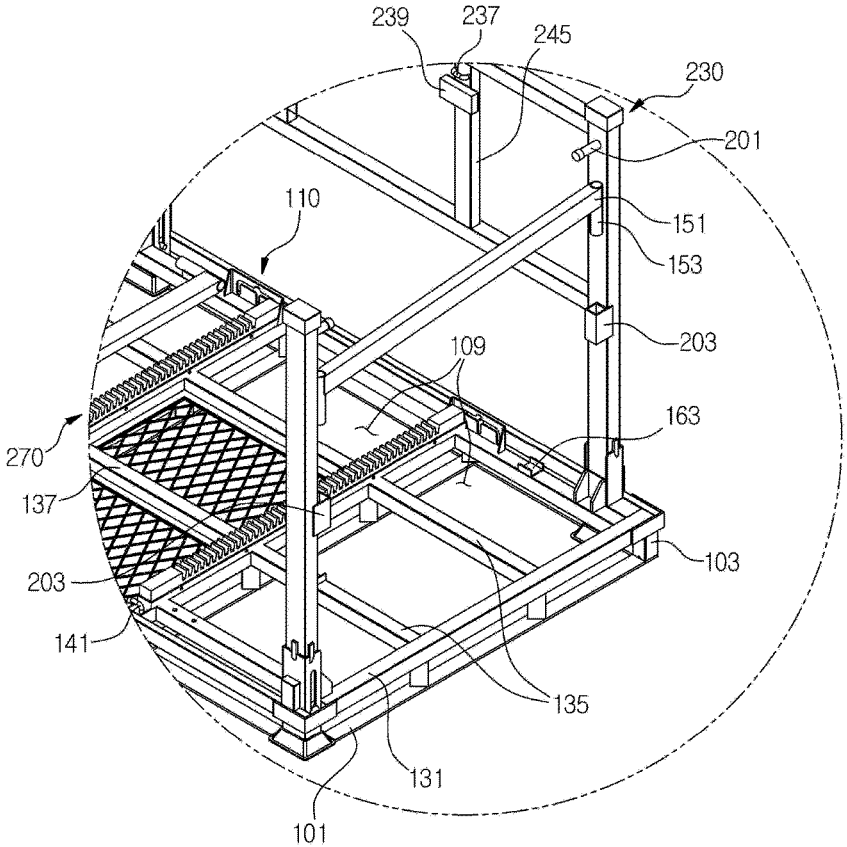
FIG. 2A is a view illustrating a state in which a side bar shown in FIG. 1 is pulled out from legs.
Figure 2B:
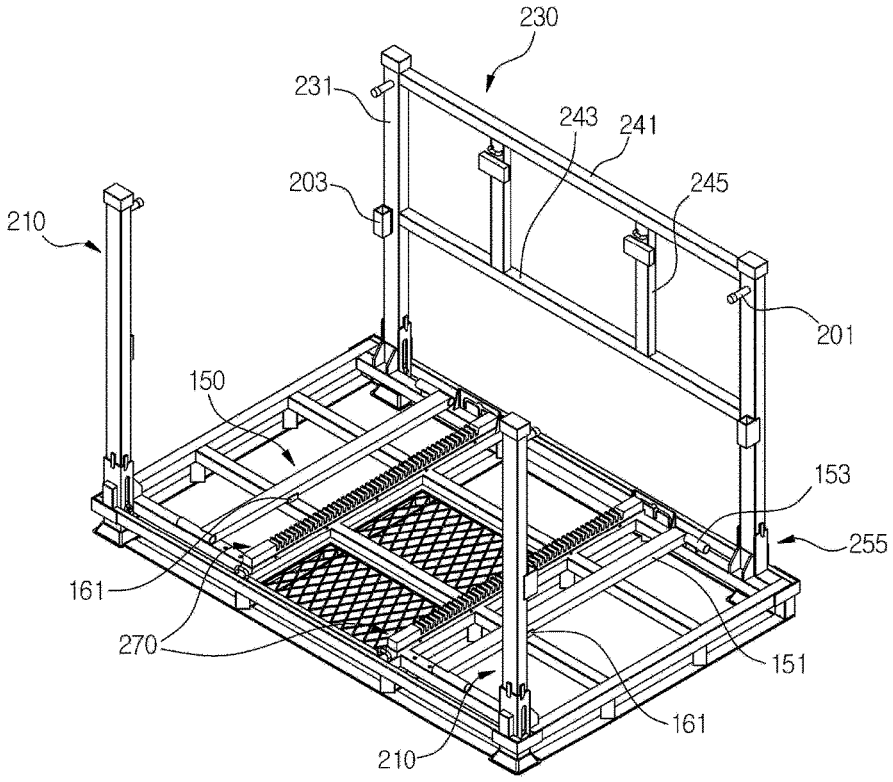
FIG. 2B is a view illustrating a state in which the side bar shown in FIG. 2A is accommodated in the pallet.
Figure 2C:
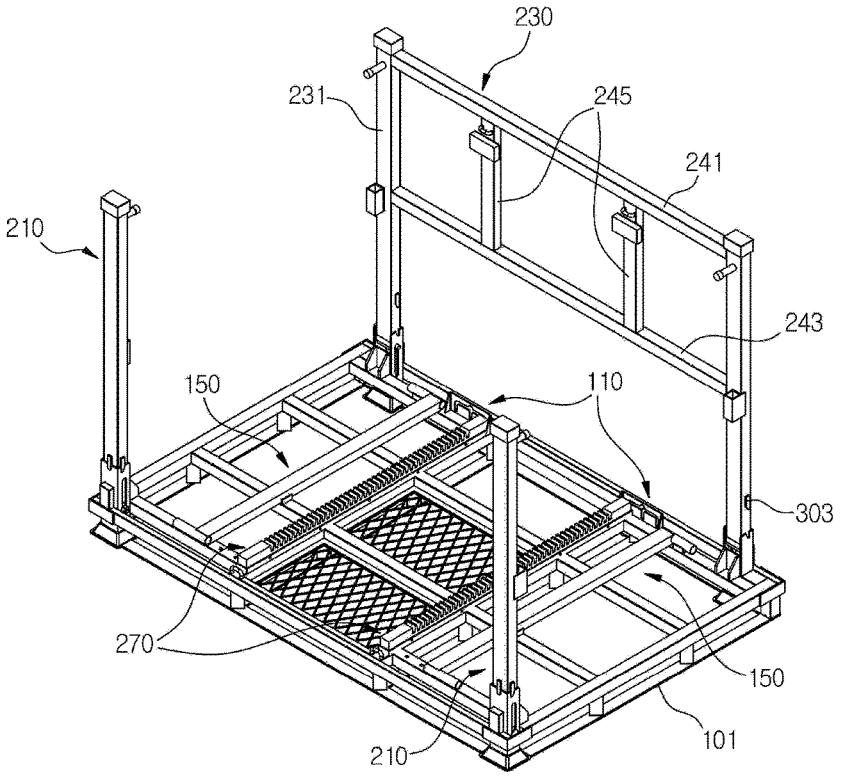
FIG. 2C is a view illustrating a state in which rear legs shown in FIG. 2B are lifted upward.
Figure 2D:
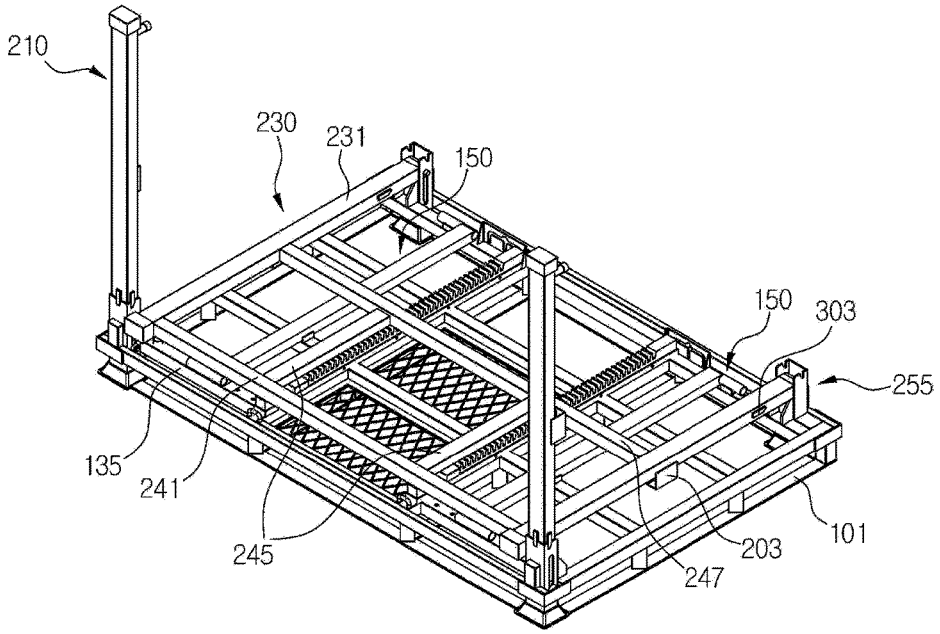
FIG. 2D is a view illustrating a state in which the rear legs shown in FIG. 2C are folded.
Figure 2E:
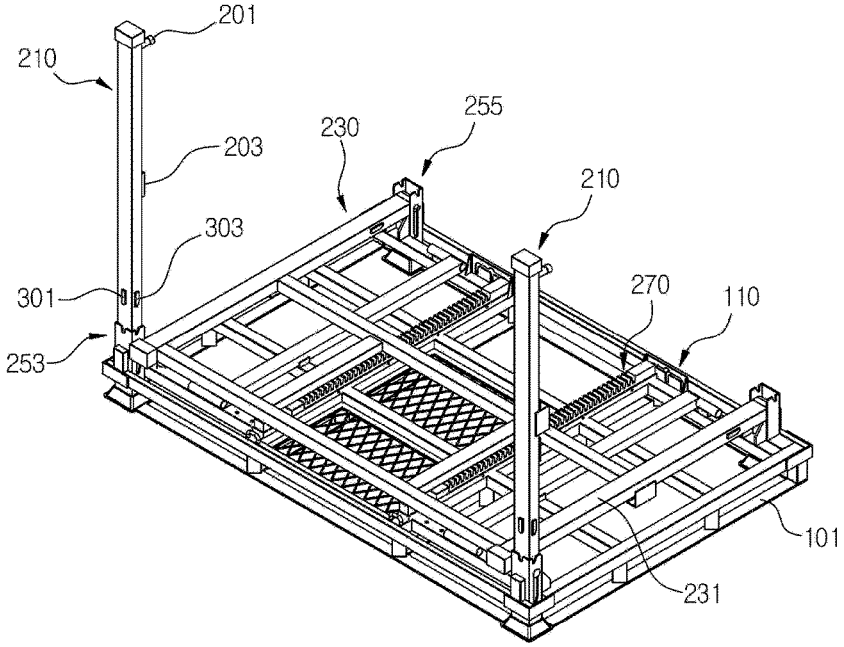
FIG. 2E is a view illustrating a state in which front legs shown in FIG. 2D are lifted upward.
Figure 2F:
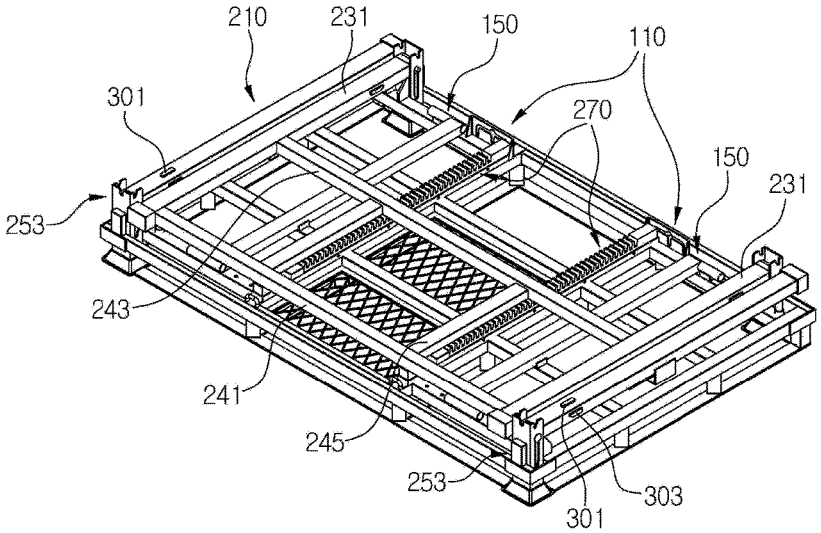
FIG. 2F is a view illustrating a state in which the front legs shown in FIG. 2E are folded.
Figure 3:
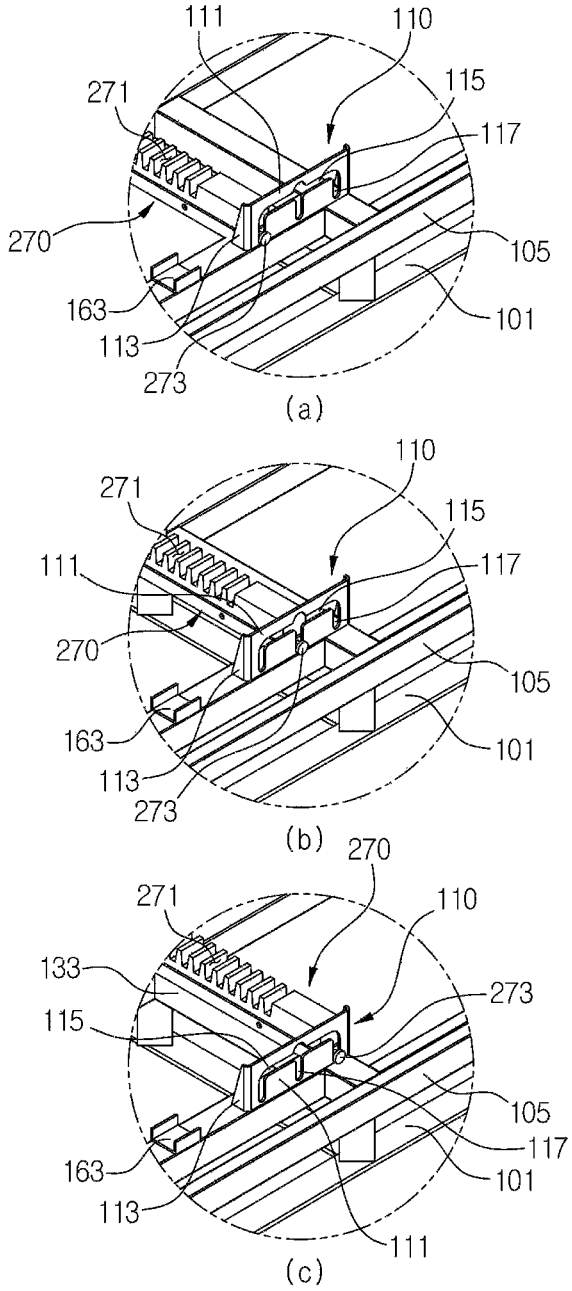
FIG. 3 shows enlarged perspective views illustrating a fixing bar according to a changed position.
Figure 4:
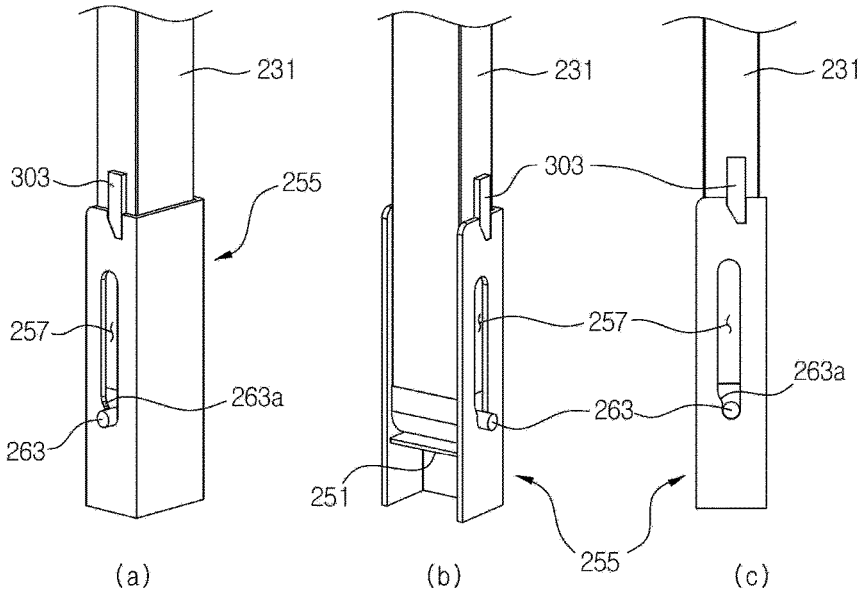
FIG. 4 shows side perspective views illustrating a front leg insertion portion and the front leg.
Figure 5:
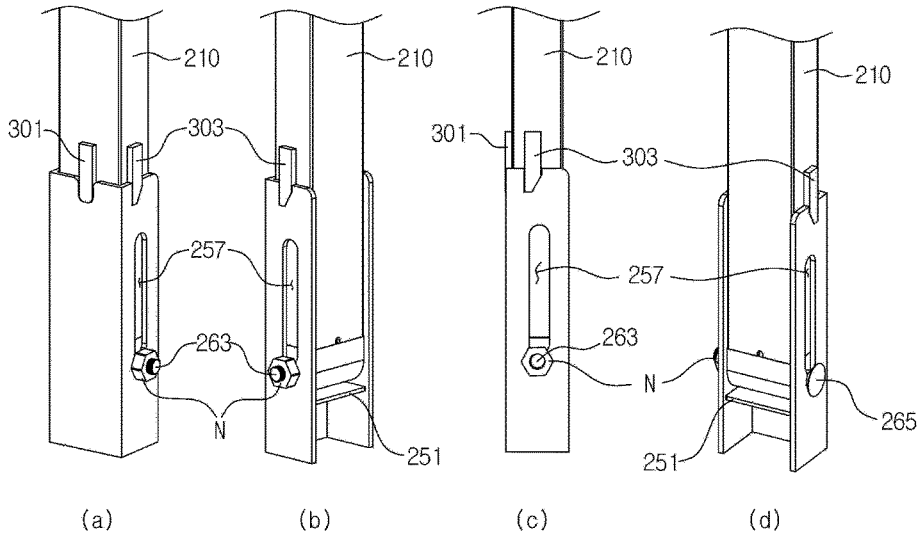
FIG. 5 shows side perspective views illustrating a rear leg insertion portion and the rear leg.

Components identical to those of a conventional technology among components of the present components that will be described below may be understood with reference to the conventional technology, and detailed descriptions thereof will be omitted.

Terms used herein are only for describing specific embodiments, and do not intend to limit the present invention. Unless the context clearly indicates otherwise, the singular forms used herein include the plural forms. The term "comprise" and "include" used herein specify specific features, regions, numbers, steps, operations, elements, and/or combinations thereof, but do not preclude presence of or addition of other specific features, numbers, regions, steps, operations, elements, and/or combinations thereof.

It should be understood that, when an element is referred to as being "connected" or "coupled" to another element, the element may be directly connected or coupled to another element or intervening elements may be present.

Hereinafter, a pallet apparatus according to a first embodiment of the present invention will be described with reference to FIGS. 1 to 5.

First Embodiment

The first embodiment for the pallet apparatus for transportation of car glass, which is suitable for transportation of front car glasses FG, includes the pallet apparatus on which car glasses FG and BG are loaded, legs including front legs 210, which are installed to be spaced apart from each other, disposed at left and right front sides of the pallet apparatus, and foldable in a front-rear direction, and rear legs 230 which are installed to be spaced apart from the front legs 210, disposed at a rear side of the pallet apparatus, and foldable in the front-rear direction so that the car glasses FG and BG are leaned on the rear legs 230, and side bars 150 of which front and rear ends are connected to the front legs 210 and the rear legs 230, respectively, when the legs are unfolded, a lateral width between the front legs 210 is greater than a lateral width between of the rear legs 230, the front legs 210 and the rear legs 230 are located at mutual side portions thereof when folded, the side bars 150 are accommodated in sidebar accommodation pieces installed in the pallet apparatus when the legs are folded, and the side bars 150 are located under the rear legs 230. Accordingly, in the present invention, since there are no assembly processes performed using bolts, a packaging process is simpler than single-use packaging process. In addition, in the present invention, since the legs are present only at the front and rear sides of the pallet, a volume of the pallet apparatus for transportation of car glass is less than that of a conventional pallet. In addition, in the present invention, since the front legs 210 and the rear legs 230 are disposed in parallel without being vertically stacked when folded, a total volume of the pallet apparatus for transportation of car glass is less than that of the conventional pallet, and since the pallet is lighter than a pallet for the above-described multi-use packaging method, a large quantity of car glasses FG and BG may be loaded at once.

Most parts of the pallet apparatus of the present invention including bottom plates 101, supports 103, connecting bars, the legs, and the like are formed of an iron material. Accordingly, in the pallet apparatus of the present invention, waste material generation is decreased from the single-use packaging method of the conventional pallet or rarely occurs, and packaging cost is low.

Hereinafter, specific parts and the like of the pallet apparatus will be described.

Bottom Portion of Pallet

A bottom portion of the pallet includes the bottom plates 101 having a shape in which three rectangular straps are sequentially connected, a plurality of supports 103 installed at edges of the bottom plates 101, the connecting bars installed above the supports 103 and formed in a lattice shape, and leg insertion portion support pieces (a numeral is not shown) installed near corners of the connecting bars and configured to come into contact with front surfaces of the front legs 210 or rear surfaces of the rear legs 230.

The support pieces (a numeral is not shown) support leg insertion portions.

The support pieces (a numeral is not shown) have a rectangular parallelepiped shape.

The connecting bars include edge connecting bars 131 installed above the supports 103 and formed in a rectangular strap shape, front-rear connecting bars 133 perpendicularly connected to front and rear side of the edge connecting bars 131, lateral connecting bars 135 perpendicularly connected to the front-rear connecting bars 133 and the edge connecting bars 131, and center connecting bars 137 perpendicularly connected to the front-rear connecting bars 133 and located between the left and right front-rear connecting bars 133.

Fixing bars 270, which will be described below, are installed on the front-rear connecting bars 133.

In the present invention, the number of the front-rear connecting bars 133 is two, and the number of the lateral connecting bars 135 is four at each of the left and right sides of the pallet apparatus so that the total number of the lateral connecting bars 135 is eight. The number of the center connecting bars 137 is four. Accordingly, nine spaces 109 surrounded by the connecting bars are formed in the pallet apparatus.

Among the spaces 109, wire meshes (a numeral is not shown) are installed in a front space 109 and a central space 109 formed between the center connecting bars 137.

Meanwhile, the fixing bars 270 on which the car glasses FG and BG are loaded and location change frames 110 connected to the fixing bars 270 are installed in the pallet apparatus of the present invention, and the fixing bars 270 are slid by the location change frames 110 to change locations thereof.

In the present invention, two fixing bars 270 are installed in the pallet apparatus for transportation of car glass to be spaced apart from each other. Accordingly, in the embodiment, since a distance between the fixing bars 270 may be adjusted to be suitable to a curvature of each lower surface of the car glasses FG and BG, transportation efficiency is increased. In addition, in the embodiment, in a case in which components are attached to the front car glasses FG, when interference occurs between the components and the fixing bars 270, the interference may be solved by changing the locations of the fixing bars 270.

A plurality of grooves 271 into which the car glasses FG and BG are inserted are formed in upper surfaces of the fixing bars 270 in a front-rear direction.

The fixing bars 270 are installed on upper surfaces of the front-rear connecting bars 133.

Hook pins 273 inserted into through holes (a numeral is not shown), which will be described below, of the location change frames 110 are formed in rear surfaces of the fixing bars 270.

It is preferable that a diameter of a rear end of the hook pin 273 be greater than that of the other portion such that the hook pin 273 may not fall out from the through hole (a numeral is not shown) while transporting.

The location change frames 110 are installed behind the lateral connecting bars 135 to be located behind the fixing bars 270.

The location change frames 110 include fixing pieces 111 in which the through holes (a numeral is not shown) are formed and reinforcing pieces 113 connected to both ends of fixing pieces 111.

The through holes (a numeral is not shown) include insertion grooves formed in a semicircular shape, through which rear ends of the hook pins 273 may be easily inserted into or fallen out, moving grooves 115 connected to the insertion grooves at centers of upper ends thereof and laterally formed in a line shape, and fixing grooves 117 extending downward from both left and right ends and centers of the moving grooves 115.

As illustrated in FIG. 3A, in a case in which the hook pin 273 is positioned in the fixing groove 117, a position of the fixing bar 270 is not changed laterally.

However, in the case in which the hook pin 273 is positioned in the fixing groove 117, when the fixing bar 270 is lifted upward and the hook pin 273 is positioned in the moving groove 115, the fixing bar 270 may be slid toward the left or right.

When the fixing bars 270 are blocked by the reinforcing pieces 113, the fixing bars 270 may not be slid toward the left or right.

Since the number of the fixing grooves 117 of the embodiment is three, the fixing bar 270 may be moved to total three locations.

Meanwhile, the side bars 150 include main bars 151 formed in a rectangular pipe shape lengthily extending in the front-rear direction, and insertion bars 153 connected to front and rear sides of the main bars 151 and formed in a cylindrical shape extending downward.

Insertion portions 203 into which the insertion bars 153 are inserted are installed at rear side centers of the front legs 210 and front side centers of the rear legs 230.

The insertion portion 203 includes four surfaces that are perpendicularly connected.

When the insertion bar 153 is inserted into the insertion portion 203, the main bar 151 is surmounted in the insertion portion 203. Accordingly, since the side bars 150 maintain distances between the front legs 210 and the rear legs 230, the legs are not folded and the pallet apparatus is structurally stable.

The side bar accommodation pieces are installed in the second and fourth lateral connecting bars 135 from the front side of the pallet apparatus. More specifically, the side bar accommodation pieces include main bar accommodation pieces 161 installed on the second lateral connecting bar 135 and configured to restrict lateral movement of the side bars 150, and insertion bar accommodation pieces 163 installed on the fourth lateral connecting bar 135 and configured to restrict front-rear movement of the side bars 150.

The side bar accommodation pieces include both side pieces and bottom pieces including both ends connected to the both side pieces, and it is preferable that the side bar accommodation piece have a cross section having a 'C' shape when the pallet apparatus is directly seen from a side thereof. That is, it is preferable that an upper side, and left and right sides or front and rear sides of the side bar accommodation piece be opened.

It is preferable that a distance between both side pieces of the insertion bar accommodation piece 163 be less than that of both side plates of the main bar accommodation piece 161. This is because the insertion bar 153 is thinner than the main bar 151.

The main bar accommodation pieces 161 are located closer to a center of the pallet apparatus than the insertion bar accommodation pieces 163 at middles of the lateral connecting bars 135, and it is preferable that the both side main bar accommodation pieces 161 be located at the left and right sides of the pallet apparatus.

The insertion bar accommodation pieces 163 are located between the location change frames 110 and the rear legs 230, and it is preferable that both sides of the insertion bar accommodation pieces 163 be located at the front side and the rear side of the pallet apparatus.

Accordingly, when the side bar 150 is accommodated in the side bar accommodation piece, the insertion bar 153 is located at the left or right of the main bar 151.

Meanwhile, in the present invention, the pallet apparatus further includes main banding straps 155 in which front and rear sides thereof are connected to the front and rear sides of the pallet apparatus, respectively, to surround the car glasses FG and BG, banding rings installed on the rear legs 230 and front sides of the connecting bars to hook the main banding straps 155, and side banding straps 157 in which upper and lower sides thereof are connected to the side bars 150 and side portions of the pallet apparatus.

The banding rings include front rings 141 connected to the front sides of the main banding straps 155 and rear rings 237 connected to the rear sides of the main banding straps 155.

The front rings 141 are located in front of the fixing bars 270.

The rear rings 237 are installed on glass fixing frames 245, which will be described below, of the rear legs 230.

The rear rings 237 are located above glass fixing pieces 239 which will be described below.

The main banding straps 155 surround upper and front sides of the car glasses FG and BG.

Here, the main banding straps 155 are not in contact with the car glasses FG and BG, and are in contact with glass grips GR installed above the car glasses FG and BG.

Meanwhile, the side banding straps 157 are installed such that upper sides thereof are hooked on the main bars 151 of the side bars 150, and lower sides thereof are hooked on the left and edge connecting bars 131. Accordingly, since the side bars 150 and the rear legs 230 are not lifted upward from the pallet apparatus, locations thereof are maintained, and thus the car glasses FG and BG may be stably transported.

One main banding strap 155 and one side banding strap 157 are installed at each of the left and right in the pallet apparatus to be located at the left and right sides of the car glasses FG and BG, respectively, so that a total of two main banding straps 155 and two side banding straps 157 are installed.

Leg

It is preferable that each of the front legs 210 and the rear legs 230 be a square pipe having a rectangular shape.

In order to protect an upper side of each of the car glasses FG and BG, upper ends of the front legs 210 and the rear legs 230 have to be located higher than upper ends of the car glasses FG and BG loaded on the pallet apparatus.

One front leg 210 is installed at each of a left corner and a right corner of the front side of the edge connecting bar 131, that is, two front legs 210 are installed in the pallet apparatus for transportation of car glass.

One rear leg 230 is installed near each of a left corner and a right corner of the rear side of the edge connecting bar 131, that is, two rear legs 230 are installed in the pallet apparatus for transportation of car glass.

The rear legs 230 include two parallel rear main frames 231, an upper connecting frame 241 perpendicularly connected to upper sides of the left and right rear main frames 231, a central connecting frame 243 perpendicularly connected to central portions of the rear main frames 231, and the glass fixing frames 245 perpendicularly connected to and located between the upper connecting frame 241 and the central connecting frame 243.

The rear main frames 231 and the front legs 210 are in parallel. Shapes of the rear main frames 231 and the front legs 210 are substantially the same.

The rear main frames 231 are installed closer to the center of the pallet apparatus than the front legs 210. Accordingly, a lateral width between the rear main frames 231 is less than the lateral width from the left front leg 210 and the right front leg 210. Accordingly, the sidebars 150 surmounted in the insertion portions 203 are inclined outward from the front side to the rear side of the pallet apparatus when directly seen from above.

Since the central connecting frame 243 faces a central portion of the loaded car glasses FG and BG, a weight of the car glasses FG and BG may be dispersed to an entire of the rear legs 230 with the glass fixing frames 245.

One glass fixing frame 245 is installed at each of the left and right in the pallet apparatus, and a total of two glass fixing frames 245 is installed.

The glass fixing frames 245 are roughly located above the location change frames 110.

A vertical length of the glass fixing frame 245 is roughly a half of a vertical length of the rear main frame 231.

Glass support pieces 239 having a rectangular parallelepiped shape, on which the car glasses FG and BG are leaned, are installed on the glass fixing frames 245.

The glass support pieces 239 are located above centers of the glass fixing frames 245.

In the pallet apparatus of the present invention, upper and front sides of the car glasses FG and BG may be supported by the main banding straps 155, left and right sides thereof may be blocked by the side banding straps 157, rear sides thereof may be supported by the rear legs, lower sides thereof are fitted into the grooves 271 of the fixing bars 270 so that a weight of the car glasses FG and BG may be uniformly dispersed on an entirety of the pallet apparatus. Accordingly, in the present invention, the loaded car glasses FG and BG may be more stably supported than those loaded on the conventional pallet.

Meanwhile, in the present invention, the pallet apparatus further includes stoppers 201 formed at the front legs 210 and the rear legs 230, when the legs are folded, the stoppers 201 are in contact with the pallet apparatus, more specifically, with a lower side of the pallet apparatus.

The stopper 201 has a circular pin shape, and an elastic piece (a numeral is not shown) is installed at an end of the stopper 201.

It is preferable that the stopper 201 be located the upper end of the leg and the insertion portion 203 and be located near the upper end of the leg, to which a most weight of the leg is applied when the leg is rotated.

Hereinafter, a configuration related to folding of the legs will be described.

The leg insertion portions into which the legs are inserted are formed in the pallet apparatus, sliding holes 257 into which shafts 263 formed at the legs are inserted are formed in the leg insertion portions, separation prevention pieces capable of being in contact with surfaces forming the leg insertion portions are formed on the legs, and when the legs are positioned at a lowermost side, separation between the surfaces forming the leg insertion portions and the separation prevention pieces is minimized or does not present.

The leg insertion portion is a square pipe including four side surfaces.

The leg insertion portions are connected to the bottom plates 101 of the pallet apparatus and further protrude upward from the connecting bars.

The leg insertion portions include front leg insertion portions 253 installed at front corners of the pallet apparatus, and rear leg insertion portions 255 installed near rear corners of the pallet apparatus.

The front leg insertion portions 253 are located between the front sides of the edge connecting bars 131 and a first front-rear connecting bar 133 from the front side of the pallet apparatus.

The rear leg insertion portions 255 are located between the rear sides of the edge connecting bars 131 and a fourth front-rear connecting bar 133 from the front side of the pallet apparatus.

Supports 205 of which areas increase toward lower sides are installed under the leg insertion portions.

The support 205 has a cross section having a rectangular shape when the pallet apparatus is directly seen from above or below.

The sliding holes 257 are long holes formed in inner and outer surfaces of the front leg insertion portions 253 and inner surfaces of the rear leg insertion portions 255 and lengthily extending vertically.

The sliding holes 257 include a portion in which a lateral width is constant, a decreasing portion including inclined surface 263*a* in which a lateral width decreases, and a lowermost side having a minimum lateral width.

The width of the lowermost side of the sliding hole 257 is the same as a diameter of the shaft 263, and a width of the remaining portions thereof are greater than the diameter of the shaft 263.

The widths of the remaining portions are widths of the decreasing portion and the portion in which the lateral width is constant.

The shaft 263 is inserted into the sliding hole 257 such that the leg vertically slides.

The shaft 263 of the leg protrudes from an inner surface or outer surface of the leg insertion portion.

Meanwhile, a female screw is formed on the shaft 263 of the front leg 210, and a nut N and a protrusion piece 265 are formed at both sides of the female screw.

By fastening the nut N, a distance between the front leg 210 and the front leg insertion portion 253 may be maintained.

The protrusion piece 265 has a cylindrical shape of which an outer diameter increases from a side of the nut N to an opposite side of the nut N.

The nut N is located on the inner surface of the front leg insertion portion 253, and the protrusion piece 265 is located on the outer surface of the front leg insertion portion 253.

Meanwhile, the separation prevention piece includes a central separation prevention piece 301 and a lateral separation prevention piece 303 each including a portion inserted into the leg insertion portion when the leg is unfolded.

Separation prevention piece insertion grooves (a numeral is not shown) into which the separation prevention pieces are inserted are formed in both side surfaces or rear surfaces of the leg insertion portions.

The separation prevention piece insertion grooves (a numeral is not shown) of the front leg insertion portions 253 are formed in upper ends of both side surfaces and the rear surfaces of the front leg insertion portions 253, and thus the central separation prevention pieces 301 and the lateral separation prevention pieces 303 may be inserted into the separation prevention piece insertion grooves.

The separation prevention piece insertion grooves (a numeral is not shown) of the rear leg insertion portions 255 are formed in upper ends of both side surfaces of the rear leg insertion portions 255, and thus the lateral separation prevention pieces 303 may be inserted into the separation prevention piece insertion grooves.

The separation prevention piece and the shaft 263 perform the same function, and the separation prevention piece insertion groove (a numeral is not shown) and the sliding hole 257 perform the same function.

In the present invention, surfaces of the leg insertion portions coming into contact with the separation prevention pieces are surfaces of the separation prevention piece insertion grooves.

It is preferable that a shape of the separation prevention piece correspond to that of the separation prevention piece insertion groove (a numeral is not shown) such that a distance between the leg and the leg insertion portion is minimized and the leg is not shaken when the leg is unfolded.

A corner of a lower end of the central separation prevention piece 301 is formed to have a curved surface.

Inclined surfaces facing inclined surfaces of left and right insertion grooves (a numeral is not shown) are formed at lower sides of the lateral separation prevention pieces 303. The inclined surface is inclined toward the center of the pallet apparatus from a lower side to an upper side of the lateral separation prevention piece 303.

The central separation prevention piece 301 and the lateral separation prevention piece 303 have a thin plate shape.

A width of each of the central separation prevention piece 301 and the lateral separation prevention piece 303 is substantially the same as that of the sliding hole 257.

In the present invention, the pallet apparatus has a structure in which, when the leg is lifted upward from a lowest side, a distance between the separation prevention piece and the separation prevention piece insertion groove (a numeral is not shown) and a distance between the shaft 263 of the leg and the sliding hole 257 are increased.

Conversely, when the leg is located at the lowest side, a distance between the separation prevention piece and the separation prevention piece insertion groove (a numeral is not shown) is minimized, and a distance between the shaft 263 of the leg and the sliding hole 257 is minimized. Accordingly, in the present invention, shaking of the leg is reliably prevented.

In addition, in the present invention, since the legs are inserted into and supported by the leg insertion portions, the legs are not lifted upward while the car glasses FG and BG are transported, and thus a situation in which the car glasses FG and BG depart from the pallet apparatus does not occur.

In addition, in the present invention, since accidental folding of the legs due to a mistake is rare, it is safe.

Meanwhile, support plates 251 in contact with the legs are formed in the leg insertion portions.

The support plate 251 has a rectangular plate perpendicularly connected to surfaces forming the leg insertion portion. Accordingly, in the present invention, since a vertical weight applied to the leg is dispersed to the leg insertion portion through the support plate 251, damages of the leg and the leg insertion portion are prevented.

Meanwhile, reinforcing bands (a numeral is not shown) in contact with the legs and the connecting bars are installed in the pallet apparatus of the present invention. Accordingly, the legs are further stably supported.

It is preferable that the reinforcing bands (a numeral is not shown) be in contact with the rear surfaces of the front legs 210 of the legs or front surfaces of the rear legs 230 thereof.

Each of the reinforcing bands (a numeral is not shown) includes two reinforcing pieces facing each other.

Meanwhile, protection caps (a numeral is not shown) may be installed on the upper ends of the legs.

Method of Folding Pallet Apparatus

Hereinafter, a method of folding the legs of the pallet apparatus according to the first embodiment will be described with reference to FIGS. 2A to 2F and 4.

First, the left and right side bars 150 are pulled out from the insertion portions 203 to be separate from the legs.

Then, the main bars 151 of the side bars 150 are accommodated in the main bar accommodation pieces 161, and the insertion bars 153 are accommodated in the insertion bar accommodation pieces 163.

Then, the rear legs 230 are lifted upward, the shafts 263 of the rear legs 230 are departed from the lowest sides of the sliding holes 257 and lifted to the upper sides of the sliding holes 257, and the lateral separation prevention pieces 303 are pulled out from the left and right insertion grooves (a numeral is not shown) of the rear leg insertion portions 255.

Then, the rear legs 230 are rotated forward and folded to be placed above the connecting bars. Here, when the stoppers 201 of the rear legs 230 come into contact with the first lateral connecting bar 135 at the front side of the pallet apparatus, the rear legs 230 are not rotated forward any more. The stoppers 201 may be slightly compressed because weights of the rear legs 230 are applied to the stoppers 201.

When the rear legs 230 are folded as described above, the side bars 150 are located between the rear legs 230 and the connecting bars.

Then, the front legs 210 are lifted upward, the shafts 263 of the front legs 210 are departed from lowest sides of the sliding holes 257 and lifted to upper sides of the sliding holes 257, and the central separation prevention pieces 301 and the lateral separation prevention pieces 303 are pulled out from the insertion grooves (a numeral is not shown) of the leg insertion portions.

Then, the front legs 210 are rotated backward and folded to be placed above the connecting bars. Here, when the stoppers 201 of the front legs 210 come into contact with the rearmost lateral connecting bar 135, the front legs 210 are not rotated backward any more. The stoppers 201 may be slightly compressed because weights of the front legs 210 are applied to the stoppers 201.

When all of the legs are folded as described above, the rear legs 230 are located between the left and right front legs 210 in the pallet apparatus. Here, it is preferable that the front legs 210 and the rear legs 230 be located to be in parallel such that the center of gravity of the pallet apparatus for transportation of car glass is not shifted to one side of the pallet apparatus, and be located in parallel to the bottom plates 101 or the connecting bars.

In addition, it is preferable that the pallet apparatus for transportation of car glass be laterally symmetrical such that the left and right sides of the pallet apparatus are balanced.

In the present invention, the empty pallet apparatus is collected after separating the side bars from the pallet apparatus and folding the legs through the above-described method.

Hereinafter, a pallet apparatus according to a second exemplary embodiment of the present invention will be described.

Second Embodiment

Figure 6:
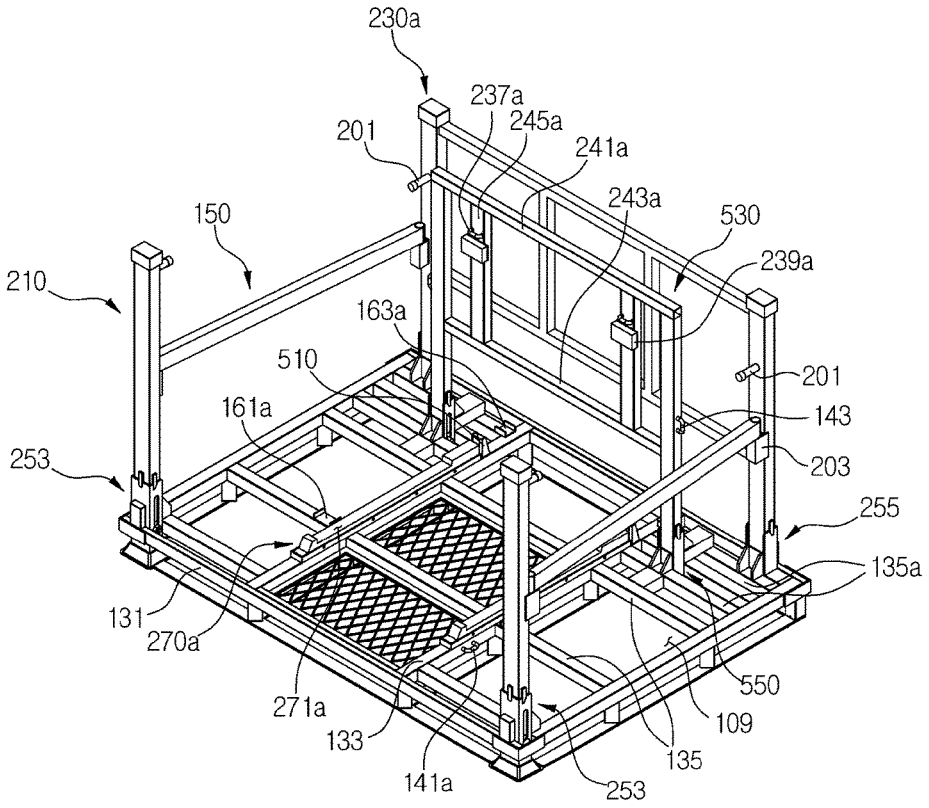
FIG. 6 is a perspective view illustrating a pallet apparatus for transportation of car glass according to a second embodiment of the present invention.
Figure 7:
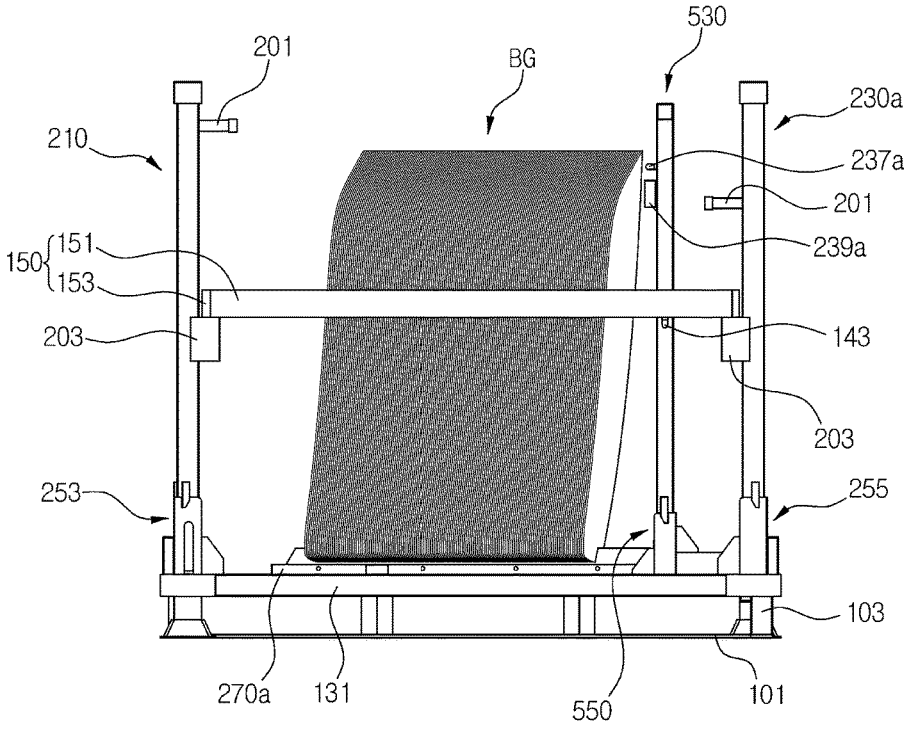
FIG. 7 is a side view illustrating a state in which rear car glasses are loaded on the pallet apparatus for transportation of car glass shown in FIG. 6.

As illustrated in FIGS. 6 and 7, the second embodiment for the pallet apparatus for transportation of car glassa, which is suitable for transportation of rear car glasses BG, includes the pallet apparatus on which the rear car glasses BG are loaded, legs including front legs 210 installed at left and right front sides of the pallet apparatus to be spaced apart from each other and to be foldable in a front-rear direction and rear legs 230*a* which are installed to be spaced apart from the front legs 210, and disposed at a rear side of the pallet 110*a*, and foldable in the front-rear direction so that the car glasses BG are leaned on the rear legs 230*a*, and side bars 150 including front and rear sides connected to the front legs 210 and the rear legs 230, respectively, when the legs are unfolded, a lateral width between the front legs 210 is greater than that between the rear legs 230*a*, the front legs 210 and the rear legs 230*a* are located at mutual side portions thereof when folded, the side bars 150 are accommodated in side bar accommodation pieces installed in the pallet apparatus and the side bars 150 are located under the rear legs 230 when the legs folded, the pallet apparatus further includes a rear glass support wall 530 installed to be located between a center, which is located between the front and rear sides of the pallet apparatus, and the rear legs 230*a*, and the rear car glasses BG located on the center of the pallet apparatus are leaned on the rear glass support wall 530.

In addition, when the legs are folded, the side bars 150 are located under the rear glass support wall 530.

In the pallet apparatus according to the second embodiment, two lateral connecting bars 135*a* are further formed in each of rear spaces 109 of left and right spaces among nine spaces 109 of the pallet apparatus according to the first embodiment. Here, support wall insertion portions 550 into which the rear glass support wall 530 is inserted are installed in the spaces 109 formed between the two lateral connecting bars 135*a*.

The support wall insertion portion 550 is fitted into the two lateral connecting bars 135*a* so that lateral movement of the support wall insertion portion 550 is restricted.

It is preferable that a configuration of the support wall insertion portion 550 be the same as the rear leg insertion portion 255 according to the first embodiment.

Fixing brackets 510 coming into contact with rear sides of fixing bars 270*a* are installed at front-rear connecting bars 133.

Meanwhile, in the pallet apparatus according to the embodiment, supports (a numeral is not shown) may be installed between a rear side of the rear glass support wall insertion portion 550 and a rear edge connecting bar 131, and between the added lateral connecting bar 135*a* and a third lateral connecting bar 135 from the front side of the pallet apparatus.

The support (a numeral is not shown) is perpendicular to the lateral connecting bar 135*a*.

In addition, in the pallet apparatus according to the embodiment, reinforcing bands (a numeral is not shown) connected to the supports (a numeral is not shown) and the rear glass support wall 530 may be in contact with front and rear surfaces of the rear glass support wall 530.

Meanwhile, a length of the rear glass support wall 530 is less than a length of the leg. An upper end of the rear glass support wall 530 is located under an upper end of the leg. Accordingly, a configuration of the rear glass support wall 530 is the same as that of the rear leg 230 according to the first embodiment, but a protection cap (a numeral is not shown) may not be installed on an upper end of the rear glass support wall 530.

In addition, a lateral width of the rear glass support wall 530 has to be less than a lateral width between the rear legs 230 according to the first embodiment such that the rear glass support wall 530 does not overlap the rear legs 230*a* or the front legs 210 when the legs and the rear glass support wall 530 are folded. Due to the same reason, it is preferable that the rear glass support wall 530 be located under the rear legs 230*a* when the legs and the rear glass support wall 530 are folded. To this end, it is preferable that a maximum lifting height of the rear glass support wall 530 be lower than that of the rear legs 230*a*. More specifically, it is preferable that upper ends of sliding holes 257 of the support wall insertion portions 550 be lower than those of sliding holes 257 of the rear leg insertion portions 255.

Meanwhile, unlike the first embodiment, the rear rings 237 and the glass support pieces 239 of the rear legs 230 according to the first embodiment may not be installed at the rear legs 230*a*, on which the car glasses FG and BG are not leaned, according to the second embodiment.

In the second embodiment, since the rear car glasses BG are leaned on the rear glass support wall 530, main banding straps 155 do not extend to the rear legs 230*a*, but extend to only the rear glass support wall 530.

Meanwhile, front rings 141*a* and rear rings 237*a* on which the main banding straps 155 according to the second embodiment are hooked may be installed on locations different from those of the first embodiment.

In the second embodiment, the front rings 141*a* are installed on outer surfaces of the front-rear connecting bars 133, and the rear rings 237*a* are installed on glass fixing frames 245*a* of the rear glass support wall 530. More specifically, the front rings 141*a* are located between first and second lateral connecting bars 135 from the front side of the pallet apparatus, and the rear rings 237*a* are located above the glass fixing pieces 239*a*. Accordingly, the main banding straps 155 may be installed to surround both side portions and upper portions of rear sides of the car glasses FG and BG.

In addition, side rings 143 on which side banding straps 157 are hooked are further installed at the pallet apparatus according to the second embodiment.

It is preferable that one side ring 143 be installed near a center of each of both side surfaces of the rear glass support wall 530.

It is preferable that the side rings 143 be located under the rear rings 237*a*.

When both ends of the side banding straps 157 are connected to the side rings 143 located on both sides of the rear glass support wall 530, the side banding strap 157 surrounds all of the both side portions and front sides of the car glasses FG and BG.

Accordingly, in the second embodiment, shaking of the car glasses FG and BG in front-rear and lateral directions is minimized.

Meanwhile, in the embodiment, since the rear glass support wall 530 is installed between the fixing bars 270*a* and rear legs 230, it is preferable that insertion bar accommodation pieces 163*a* be installed closer to a center of the pallet apparatus than main bar accommodation pieces 161*a* among side bar accommodation pieces.

More specifically, it is preferable that the insertion bar accommodation pieces 163*a* be installed on rear lateral connecting bars 135*a* among lateral connecting bars 135*a* added to be located at rear sides of the fixing bars 270*a*.

The main bar accommodation pieces 161*a* are installed on a second lateral connecting bar 135 from the front side of the pallet apparatus and located near the side portions of the fixing bars 270*a*.

Meanwhile, the above-described first embodiment is suitable for transportation of the front car glasses FG because, in the case in which small components are attached to the front car glass FG, the front car glasses FG may be loaded on the pallet apparatus for transportation of car glass in a state in which the distances between the front car glasses FG are maintained.

On the other hand, the second embodiment is suitable for transportation of the rear car glasses BG because additional components are not attached to the rear car glasses BG and a plurality of rear car glasses BG may be loaded on the pallet apparatus for transportation of car glassa in a state in which the plurality of rear car glasses BG are pressed against each other. Accordingly, in the second embodiment, a plurality of grooves 271 are not formed unlike the first embodiment, and it is preferable that only one groove 271*a* having a long front-rear length be formed on each of the fixing bars 270*a*, and there be no location change frames 110.

In addition, in the pallet apparatus for transportation of car glassa according to the second embodiment, since the car glasses BG are loaded on a center of the front, rear, left, and right sides of the pallet apparatus for transportation of car glassa as illustrated in FIG. 6, a center of gravity of the car glasses BG is located at the center of the pallet apparatus. Accordingly, in the second embodiment, a larger quantity of rear car glasses BG may be loaded on the pallet apparatus than the conventional pallet.

The parts and effects of the second embodiment except the above-described parts and effects thereof are the same as those of the first embodiment.

Meanwhile, in the present invention, belts (not shown) may also be used instead of the banding straps 155 and 157 unlike the above-described embodiments.

As described above, although the exemplary embodiments of the present invention have been described, the present invention may be made by those skilled in the art by variously changing and modifying the present invention within a range without departing from the spirit and scope of the present invention described in the claims.

The invention claimed is:

1. A pallet apparatus for transportation of car glass comprising:

a pallet on which a car glass is loaded;

legs including front legs which are spaced apart from each other, disposed at left and right front sides of the pallet, and installed to be foldable in a front-rear direction, and rear legs which are spaced apart from the front legs, installed to be foldable in the front-rear direction, and disposed at a rear side of the pallet so that the car glass is leaned on the rear legs; and side bars including front and rear sides connected to the front legs and the rear legs, respectively, when the legs are unfolded, wherein a lateral width between the front legs is greater than that between the rear legs, and when the front legs and the rear legs are folded, the front legs and the rear legs are located at mutual side portions thereof, and the side bars are accommodated in side bar accommodation pieces installed on the pallet, and the side bars are located under the rear legs.

2. The pallet apparatus for transportation of car glass of claim 1, wherein: leg insertion portions into which the legs are inserted are formed in the pallet;

sliding holes into which shafts formed in the legs are inserted are formed in the leg insertion portions; and support plates in contact with lower surfaces of the legs are formed at the leg insertion portions.

3. The pallet apparatus for transportation of car glass of claim 2, wherein:

separation prevention pieces configured to be in contact with the leg insertion portions are formed in the legs; and when the leg is located at a lowermost side, a distance between surfaces of the leg insertion portion and the separation prevention piece is minimized or becomes zero.

4. The pallet apparatus for transportation of car glass of claim 2, wherein a width of a lowermost side of the sliding hole is the same as a diameter of the shaft, and widths of other portions of the sliding hole are greater than the diameter of the shaft.

5. The pallet apparatus for transportation of car glass of claim 1, wherein:

a fixing bar on which the car glass is loaded and a location change frame connected to the fixing bar are installed in the pallet; and the fixing bar is configured so as to be able to slide by the location change frame to change a location of the fixing bar.

6. The pallet apparatus for transportation of car glass of claim 1, further comprising:

a main banding strap including a front side and a rear side connected to the front side and the rear side of the pallet to surround the car glass; and side banding straps including upper sides and lower sides connected to the side bars and side portions of the pallet.

7. The pallet apparatus for transportation of car glass of claim 1, further comprising stoppers formed on the front legs and the rear legs, wherein, when the legs are folded, the stoppers are in contact with the pallet.

8. The pallet apparatus for transportation of car glass of claim 1, further comprising a rear glass support wall installed in the pallet to be located between the rear legs and a center of the front side and the rear side of the pallet, wherein a rear car glass located at the center of the pallet is leaned on the rear glass support wall.

* * * * *